US005328026A

United States Patent [19]

Newman

[11] Patent Number: 5,328,026

[45] Date of Patent: Jul. 12, 1994

[54] FLAT MULTIPLE TOOL HOLDER

[76] Inventor: Chris M. Newman, 13315 E. 25th St., Spokane, Wash. 99216

[21] Appl. No.: 75,639

[22] Filed: Jun. 11, 1993

[51] Int. Cl.[5] ..... A45C 11/00; B65D 69/00

[52] U.S. Cl. ..... 206/234; 206/37; 206/37.1; 206/38

[58] Field of Search ..... 206/234, 38, 37, 37.1, 206/39.6

[56] References Cited

U.S. PATENT DOCUMENTS

| | | | |
|---|---|---|---|
| 464,405 | 12/1891 | Widmann | 206/38 R |
| 973,930 | 10/1910 | Fink | 206/38 |
| 1,590,492 | 6/1926 | Benson | 206/38 |
| 2,412,056 | 12/1946 | Mosch | 206/38 |
| 2,630,212 | 3/1953 | Mosch | 206/38 |
| 4,037,716 | 7/1977 | Marks | 206/38 |
| 4,300,610 | 11/1981 | China | 206/37 |
| 4,331,194 | 5/1982 | Lederer | 206/37 X |
| 4,457,425 | 7/1984 | Cooper et al. | 206/37 X |
| 4,934,528 | 6/1990 | Miller et al. | 206/37.1 X |
| 4,946,030 | 8/1990 | Guridi et al. | 206/37.1 |
| 5,080,223 | 1/1992 | Mitsuyama | 206/38 X |

*Primary Examiner*—William I. Price

*Attorney, Agent, or Firm*—John R. Flanagan

[57] ABSTRACT

A flat multiple tool holder includes a generally flat card-like substrate having an interior and a pair of opposite end edges, and a plurality of separate pockets in the interior of the substrate. Each pocket is open at one of the opposite end edges of the substrate. Further, each pocket is shaped to match a profile of a given one of a plurality of different tools. The flat card-like substrate is formed by front, rear and middle layers laminated together in a sandwiched facing relationship with one another. The front and rear layers of the substrate are solid layers. The middle layer of the substrate has a plurality of separate voids or cutouts defined therein. Each of the cutouts is shaped to match a profile of a given one of a plurality of different tools. When the three layers are sealed or laminated together, these cutouts define pockets in the holder for receiving the various tools.

20 Claims, 2 Drawing Sheets

FLAT MULTIPLE TOOL HOLDER

BACKGROUND OF THE INVENTION

1. Field of the Invention

The present invention generally relates to utensil holders and, more particularly, is concerned with a flat card-like multiple tool holder.

2. Description of the Prior Art

Many people desire to carry a number of different utensils or tools, such as a knife, bottle opener, nail file, screw driver, mirror, toothpick and tweezers, in a pocket or handbag. However, these tools typically have rough surfaces, sharp edges or pointed tips. Thus, the user must be protected from injury due to inadvertent or accidental contact with these tools when reaching into the pocket or handbag.

A number of different holder devices which contain these different commonly-used tools have been proposed in the prior patent art. Representative examples of these tool holder devices are the ones disclosed in U.S. patents to Fink (973,930), Benson (U.S. Pat. No. 1,590,492) and Mosch (U.S. Pat. Nos. 2,412,056 and 2,630,212). However, a common drawback of these devices is that they have heavy, complicated and expensive constructions.

Consequently, a need still exists for a multiple tool holder which is simple in construction and small in size and avoids the drawback of the prior art.

SUMMARY OF THE INVENTION

The present invention provides a flat multiple tool holder designed to satisfy the aforementioned need. The flat multiple tool holder of the present invention has the configuration of a credit card which conveniently fits into a user's pocket, purse, or wallet, occupying only minimal space and stores multiple everyday or commonly-used tools in an organized fashion. People are accustomed to carrying credit cards, so configuring the tool holder of the present invention to resemble a credit card will attract user interest. Further, the construction of the tool holder is very simple making the tool holder very inexpensive to manufacture.

Accordingly, the present invention is directed to a flat multiple tool holder which comprises: (a) a generally flat card-like substrate having an interior and a pair of opposite end edges; and (b) means defining a plurality of separate pockets in the interior of the substrate. Each pocket is open at one of the opposite end edges of the substrate. Further, each pocket is shaped to match a profile of a given one of a plurality of different tools.

More particularly, the flat card-like substrate can be formed by front, rear and middle layers being laminated together in a sandwiched facing relationship with one another. The front and rear layers of the substrate are substantially solid layers. The middle layer of the substrate has a plurality of separate cutouts defined therein. Each of the cutouts is shaped to match a profile of a given one of a plurality of different tools. When the three layers are sealed or laminated together, these voids or cutouts define pockets in the holder for receiving the various tools. Alternatively, the middle and front layers or the middle and rear layers can be fabricated as one layer and then laminated with the remaining layer or the layers can be molded in one complete unit.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
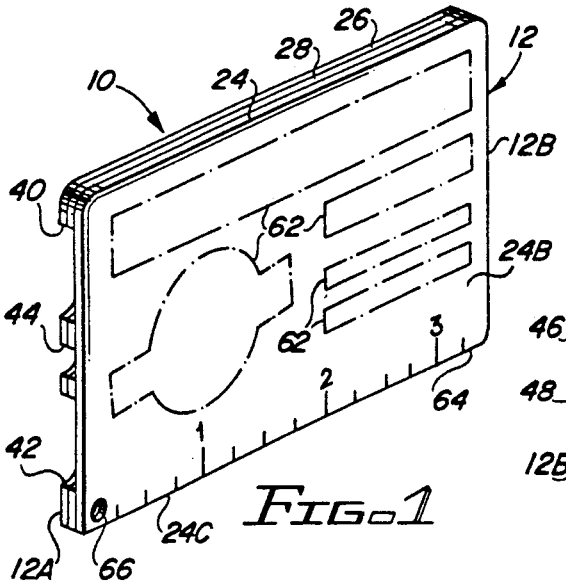
FIG. 1 is a front perspective view of a flat multiple tool holder of the present invention.
Figure 2:
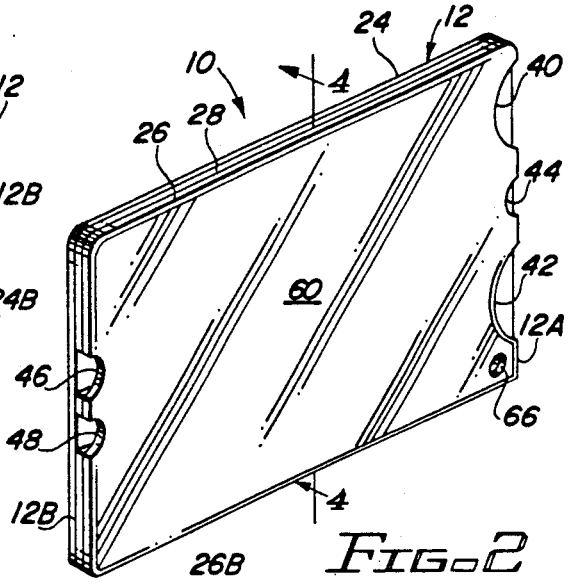
FIG. 2 is a rear perspective view of a flat multiple tool holder of FIG. 1.
Figure 4:
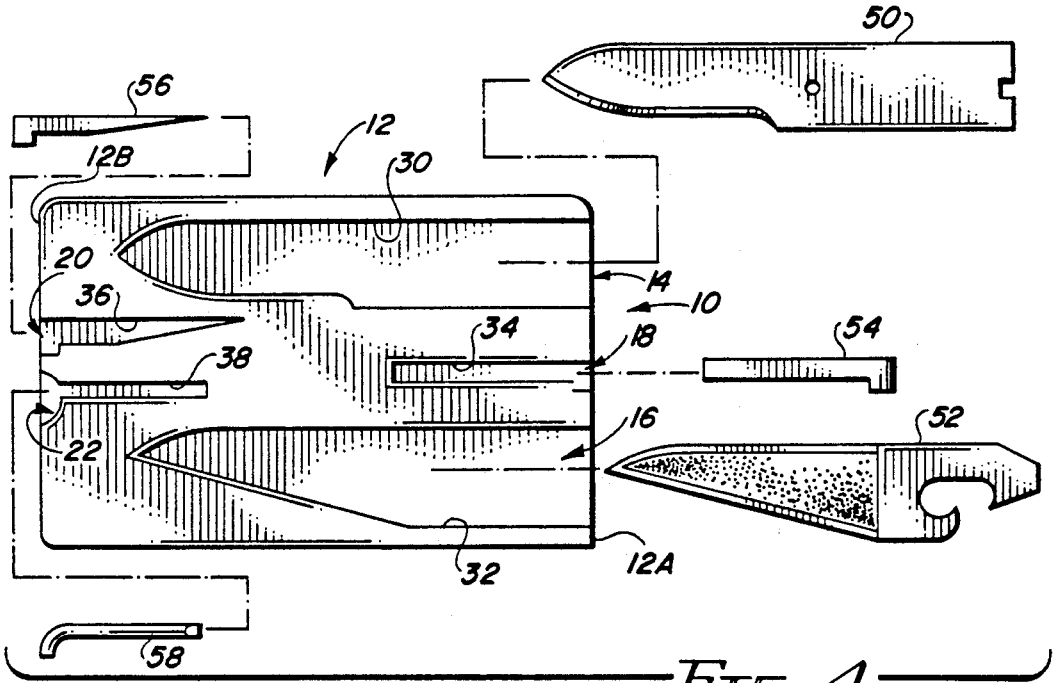
FIG. 4 is a longitudinal sectional view of the holder taken along a plane through line 4—4 extending between the rear and middle layers and also showing the various tools lined up with their corresponding pockets in the holder.
Figure 5:
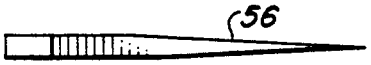
FIG. 5 is a side elevational view of a toothpick which is stored in the holder.
Figure 6:
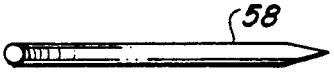
FIG. 6 is a side elevational view of a screwdriver which is stored in the holder.

Referring to the drawings and particularly to FIGS. 1 to 4, there is illustrated a flat multiple tool holder, generally designated 10, of the present invention. Basically, the flat multiple tool holder 10 includes a generally flat card-like substrate 12 having a plurality of separate pockets 14, 16, 18, 20 and 22 defined in the interior of the substrate 12. Each of the pockets 14, 16, 18, 20 and 22 opens at one of a pair of opposite end edges 12A, 12B of the substrate 12. Also, each pocket 14, 16, 18, 20, 22 is shaped to match a profile of a given one of a plurality of different tools which will be described below.

More particularly, in the illustrated embodiment the flat card-like substrate 12 is formed by a plurality of front, rear and middle layers 24, 26 and 28 being laminated together in a sandwiched facing relationship with one another. The front and rear layers 24, 26 of the substrate 12 are substantially solid layers. The middle layer 28 of the substrate 12 is in the form of a template having a plurality of separate cutouts 30, 32, 34, 36, 38 defined therein. In the illustrated embodiment, the layers 24, 26, 28 have substantially the same rectangular configurations; however, other shapes and configurations can be employed.

Each of the cutouts 30, 32, 34, 36, 38 is shaped to match the profile of a given one of the plurality of different tools. When the three layers 24, 26, 28 are sealed or laminated together, these voids or cutouts 30, 32, 34, 36, 38 in conjunction with inner facing surfaces 24A, 26A of the solid front and rear layers 24, 26 define the separate pockets 14, 16, 18, 20, 22 in the tool holder 10 for receiving the various tools. Alternatively, the middle and front layers 28, 24 or the middle and rear layers 28, 26 can be fabricated as one layer and then laminated with the remaining layer. The various layers are preferably fabricated from any suitable plastic material by using conventional techniques.

Preferably, the thickness of the middle layer 28 is less than the thickness of each of the tools stored in the pockets 14, 16, 18, 20, 22 to provide a frictional fit therebetween which deters or prevents the tools from inadvertently falling out of the pockets. The back layer 26 also has enlarged entrance recesses 40, 42, 44, 46, 48 defined therein at the opposite end edges 12A, 12B of the substrate 12 to enable the user in gripping the tools with his or her fingers to pull them out of the pockets 14, 16, 18, 20, 22.

Referring to FIGS. 4–7, there is illustrated typical tools which can be employed by the tool holder 10 of the present invention. The illustrated tools are a knife 50, a combination nail file/can opener 52, tweezers 54, a toothpick 56 and a screwdriver 58. A mirrored surface is fabricated on the outer surface 26B of the rear layer 26 in order to provide a mirror 60 thereon. These tools can be separately withdrawn and used independently of one another. The tool holder 10 can be designed to store other types of tools than the ones mentioned above. Also, the tools can be metal or plastic as appropriate to the particular tool function.

Figure 7:
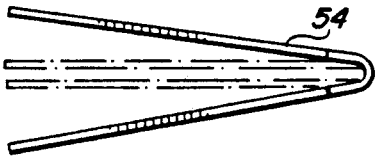
FIG. 7 is a side elevational view of tweezers which is stored in the holder.
Figure 3:
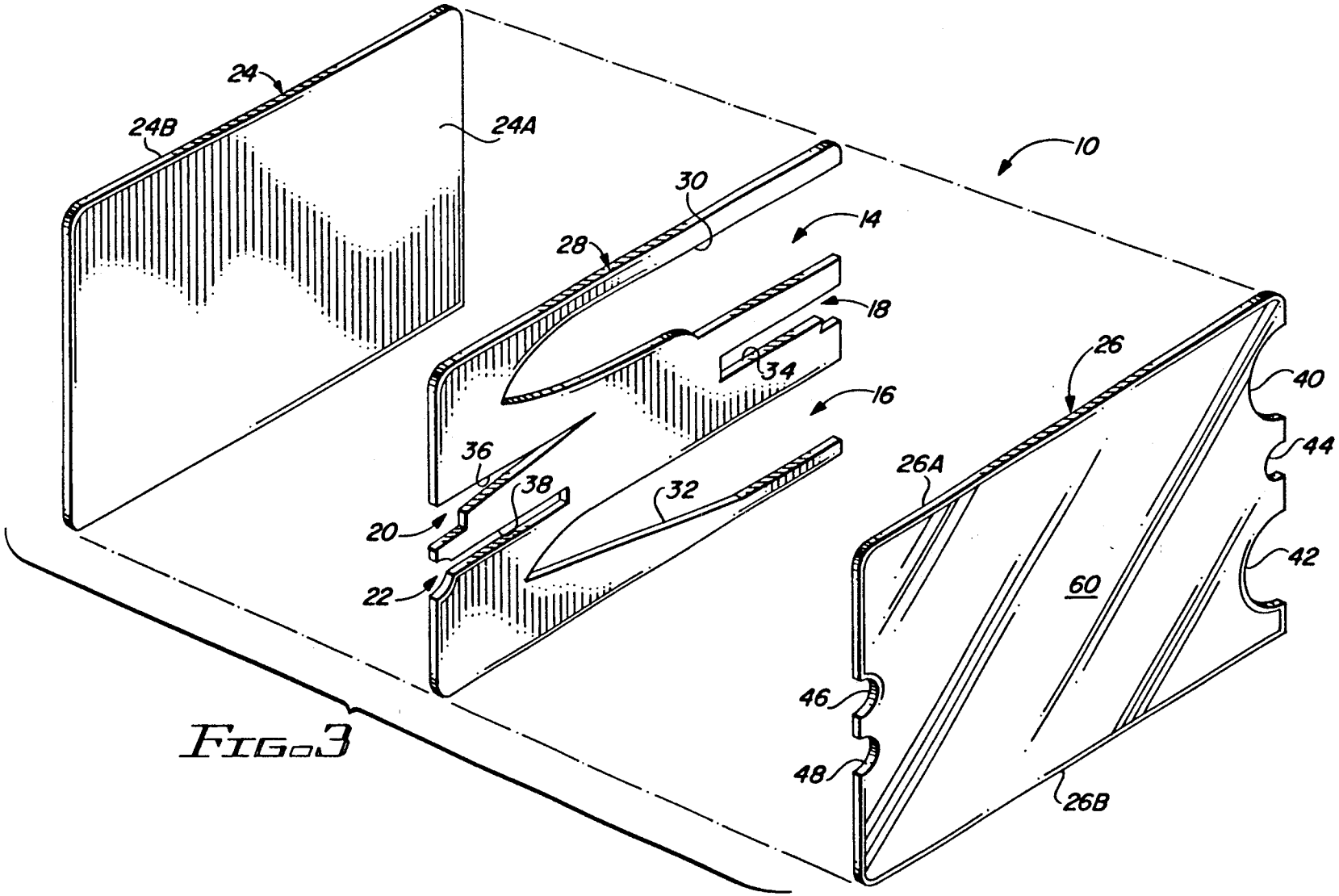
FIG. 3 is an enlarged exploded view of front, rear and middle layers which are laminated together to form the flat multiple tool holder of the present invention.

Furthermore, the outer surface 24B of the front layer 24 has regions 62 upon which logo and advertising material and other information can be printed. The front layer 24 also has a measuring scale 64 defined along one longitudinal edge 24C thereof. Also, a key chain hole 66 is provided as shown in FIGS. 1 and 7.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A flat multiple tool holder, comprising:

(a) a generally flat card-like substrate having an interior and a plurality of end edges; and (b) means defining a plurality of separate pockets in the interior of said substrate, each of said pockets being open at one of said end edges of said substrate, each of said pockets being shaped to match a profile of a given one of a plurality of different tools to be stored in said pockets of said substrate.

2. The holder of claim 1 wherein said substrate is formed by a plurality of layers being laminated together in a sandwiched facing relationship with one another.

3. The holder of claim 1 wherein said substrate is formed by front, rear and middle layers being laminated together in a sandwiched facing relationship with one another.

4. The holder of claim 3 wherein said front and rear layers of said substrate are substantially solid layers.

5. The holder of claim 3 wherein said middle layer of said substrate has a plurality of separate cutouts defined therein, each of said cutouts being shaped to match a profile of a given one of a plurality of different tools to be stored in said holder, said cutouts when said layers are sealed together defining said pockets for receiving the different tools.

6. The holder of claim 3 wherein the thickness of said middle layer is less than the thickness of each of the tools to be stored in said pockets so as to provide a frictional fit therebetween which deters the tools from inadvertently falling out of said pockets.

7. The holder of claim 3 wherein said back layer also has enlarged entrance recesses defined therein at said opposite end edges of said substrate to enable the user in gripping the tools with the user's fingers to pull them out of said pockets.

8. The holder of claim 1 wherein an outer surface of said substrate has regions thereon upon which a mirror surface and logo, advertising material and other information can be printed.

9. The holder of claim 1 wherein an outer surface of said substrate has a measuring scale defined along one longitudinal edge thereof.

10. A flat multiple tool holder, comprising:

(a) a generally flat card-like substrate having an interior and a plurality of end edges;

(b) means defining a plurality of separate pockets in the interior of said substrate, each of said pockets being open at one of said end edges of said substrate, each of said pockets being shaped to match a profile of a given one of a plurality of different tools to be stored in said pockets of said substrate; and (c) a plurality of tools removably stored in said pockets of said substrate.

11. The holder of claim 10 wherein said plurality of tools includes two or more of the following tools: a knife, a combination nail file/can opener, tweezers, a toothpick and a screwdriver.

12. The holder of claim 10 wherein said substrate is formed by a plurality of layers being laminated together in a sandwiched facing relationship with one another.

13. The holder of claim 10 wherein said substrate is formed by front, rear and middle layers being laminated together in a sandwiched facing relationship with one another.

14. The holder of claim 13 wherein said front and rear layers of said substrate are substantially solid layers.

15. The holder of claim 13 wherein said middle layer of said substrate has a plurality of separate cutouts defined therein, each of said cutouts being shaped to match a profile of a given one of a plurality of different tools to be stored in said holder, said cutouts when said layers are sealed together defining said pockets for receiving the different tools.

16. The holder of claim 13 wherein the thickness of said middle layer is less than the thickness of each of the tools to be stored in said pockets so as to provide a frictional fit therebetween which deters the tools from inadvertently falling out of said pockets.

17. The holder of claim 13 wherein said back layer also has enlarged entrance recesses defined therein at said opposite end edges of said substrate to enable the user in gripping the tools with the user's fingers to pull them out of said pockets.

18. The holder of claim 10 wherein an outer surface of said substrate has regions thereon upon which logo and advertising material and other information can be printed.

19. The holder of claim 10 wherein an outer surface of said substrate has a measuring scale defined along one longitudinal edge thereof.

20. A flat multiple tool holder, comprises:

(a) a generally flat card-like substrate formed by front, rear and middle layers being laminated together in a sandwiched facing relationship with one another, said substrate having a hole therein for connection with a key chain;

(b) said front and rear layers of said substrate being substantially solid layers, said middle layer of said substrate having a plurality of separate cutouts defined therein, each of said cutouts being shaped to match a profile of a given one of a plurality of different tools;

(c) said cutouts in said middle layer of said substrate being open at one of a pair of opposite edges of said middle layer such that a plurality of separate pockets for receiving a plurality of different tools are defined by said cutouts in the interior of said substrate formed by said laminated front, rear and middle layers.

* * * * *